US006997262B2

(12) United States Patent
Palmer et al.

(10) Patent No.: US 6,997,262 B2
(45) Date of Patent: Feb. 14, 2006

(54) EMERGENCY CUTTING APPARATUS AND METHOD

(75) Inventors: Larry T. Palmer, Houston, TX (US); James S. Trahan, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 128 days.

(21) Appl. No.: 10/620,306

(22) Filed: Jul. 14, 2003

(65) Prior Publication Data

US 2004/0089451 A1 May 13, 2004

Related U.S. Application Data

(60) Provisional application No. 60/398,848, filed on Jul. 25, 2002.

(51) Int. Cl.
*E21B 29/04* (2006.01)

(52) U.S. Cl. ..... 166/298; 166/54.6

(58) Field of Classification Search ..... 166/297, 166/298, 54.5, 54.6, 55, 55.6
See application file for complete search history.

(56) References Cited

U.S. PATENT DOCUMENTS 1,491,610 A 4/1924 Liady
1,776,026 A 9/1930 Hinderliter
2,495,953 A 1/1950 Austin
4,817,725 A * 4/1989 Jenkins ..... 166/54.5
4,945,985 A 8/1990 Lynds
4,981,177 A 1/1991 Carmody et al.
5,720,348 A 2/1998 Hisaw
6,296,053 B1 10/2001 Hansen
2001/0045283 A1 11/2001 Leismer

FOREIGN PATENT DOCUMENTS

WO WO 02/090710 A2 11/2002

* cited by examiner

*Primary Examiner*—David Bagnell

*Assistant Examiner*—Matthew J. Smith

(74) *Attorney, Agent, or Firm*—Gerald W. Spinks

(57) ABSTRACT

A method and apparatus for cutting one or more longitudinal members, external to a downhole tubular conduit, by pulling upward on a cutter body attached to the tubular conduit, where the longitudinal members are run between cutter knives within the cutter body. The cutter knives are attached to one external longitudinal member. After the main tubular conduit is cut below the cutter body, the tubular conduit is pulled, lifting the cutter body, thereby engaging the cutter knives with sloping surfaces on the cutter body to force the knives together, severing the external longitudinal members.

10 Claims, 3 Drawing Sheets

EMERGENCY CUTTING APPARATUS AND METHOD

CROSS REFERENCE TO RELATED APPLICATIONS

This application depends upon the priority of U.S. Provisional App. No. 60/398,848, filed Jul. 25, 2002, for "Emergency Cutting Apparatus And Method".

STATEMENT REGARDING FEDERALLY SPONSORED RESEARCH OR DEVELOPMENT

Not Applicable

BACKGROUND OF THE INVENTION

1. Field of the Invention

The present invention is in the field of equipment used to sever downhole members, such as production tubing or other tubular conduits, as well as wirelines, control lines, vent lines, and other longitudinal members which may be run in the well external to the tubular conduit.

2. Background Art

In many applications in oil or gas wells, a tubular conduit such as production tubing is run into the well bore with a bottom hole assembly attached. The bottom hole assembly may have a wireline, control line, vent line, or other longitudinal member attached to it. Typically, this wireline, vent line, control line, or other such longitudinal member will be run externally to the production tubing. Such longitudinal members will be referred to as external longitudinal members herein. Often, there may be several such external longitudinal members run into the well bore along with, and external to, the production tubing or other main tubular conduit.

In some circumstances, it becomes necessary to cut or sever the main tubular conduit at a point downhole, and to pull the tubular conduit back out of the hole, leaving the severed lower portion of tubular conduit, and the bottom hole assembly attached thereto, in the well bore. This also necessitates the cutting of the external longitudinal members, preferably without a separate operation for running specialized cutting equipment into the well bore. It is also desirable to be able to cut the wire line, vent line, or control line somewhere downhole as close as possible to the point at which the tubular conduit is cut, to salvage as much as possible of the external longitudinal member and keep the well bore as open as possible.

BRIEF SUMMARY OF THE INVENTION

The present invention provides a method and apparatus for severing one or more external longitudinal members, with a cutting tool attached to the main tubular conduit, above the bottom hole assembly. By way of example, the cutting tool can consist of a cutter body which can be clamped in place on the external surface of the main tubular conduit, such as by capturing the cutter body between two couplers threaded onto the tubular conduit. Inside the cutter body are one or more cutter knives which can slide longitudinally relative to the cutter body. These cutter knives are fixedly attached to the external longitudinal member, such as by being clamped thereto. If there are several external longitudinal members, it is usually only necessary to attach the cutter knives to one of them. In any case, the external longitudinal member or members are routed through the cutter body so as to be exposed to the cutting edge of the knife or knives. If there are several knives, they can be oriented facing each other, and the external longitudinal member or members are routed between the cutting edges on the cutter knives. A surface on each cutter knife abuts an actuating surface on the cutter body, with this actuating surface sloping downwardly, and transversely to the longitudinal axis of the cutting tool. If there are several cutter knives, there can be a single conical actuating surface, or several actuating surfaces.

If it becomes necessary to sever the main tubular conduit and retrieve the upper portion, this operation is first accomplished below the cutting tool, by any means known in the art. The upper portion of the tubular conduit is then pulled upwardly, or uphole, to retrieve it from the well.

After the tubular conduit is severed, pulling upwardly on the tubular conduit will also lift the cutter body upwardly, or in an uphole direction. At the same time, the external longitudinal member to which the cutter knives are attached is still attached to the bottom hole assembly, thereby holding the cutter knives in place longitudinally in the well bore. The uphole movement of the cutter body relative to the cutter knives causes the sloping actuating surfaces on the cutter body to engage the abutting surfaces on the cutter knives and force the cutter knives toward each other, or inwardly. This drives the cutting edges of the cutter knives through the external longitudinal member or members, severing them. This allows the external longitudinal member or members above the cutting tool to be retrieved from the well bore.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
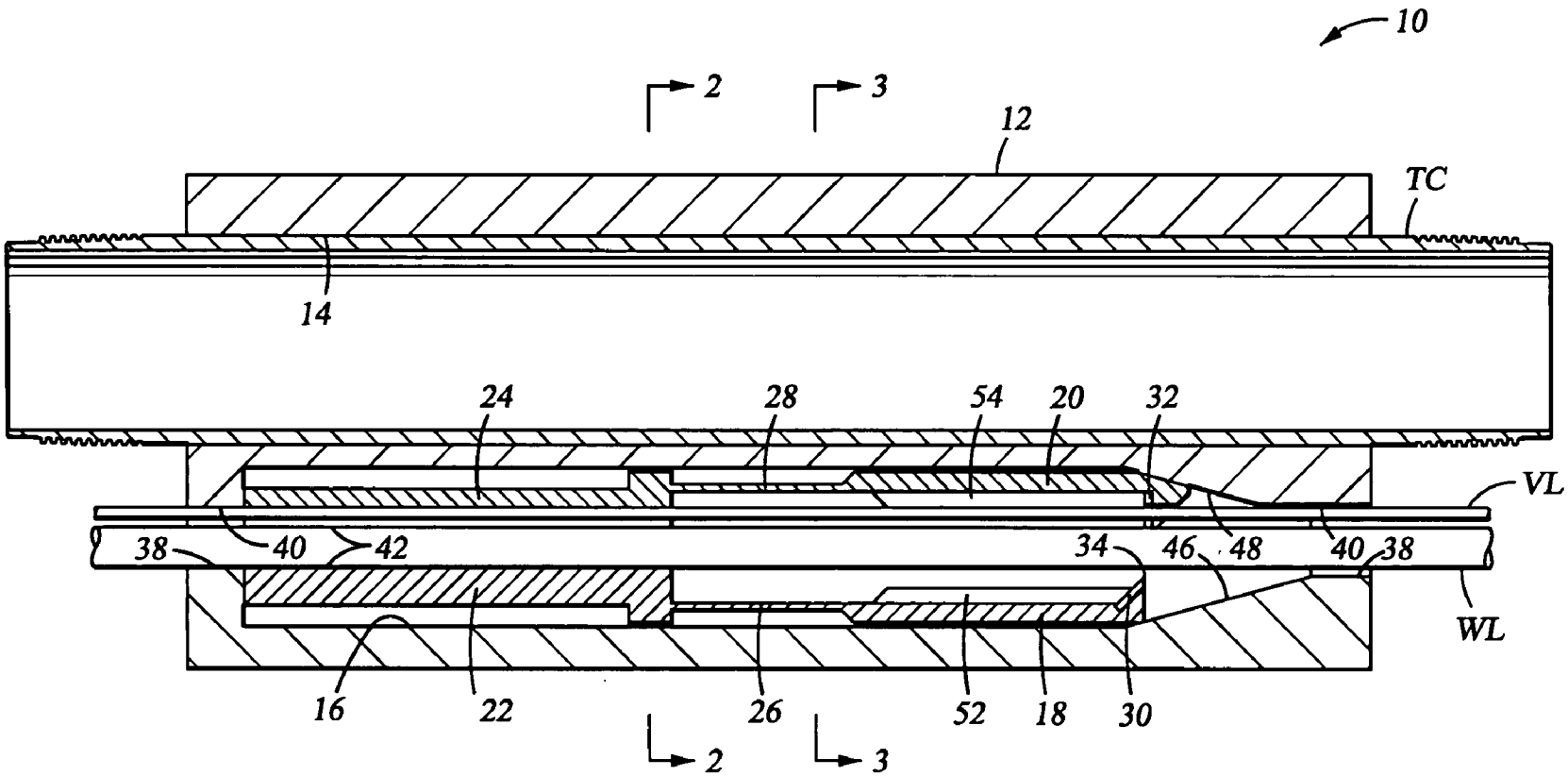
FIG. 1 is a longitudinal section view of the apparatus of the present invention, showing its attachment to a tubular conduit, a vent line, and a wire line.

As shown in FIG. 1, a preferred embodiment of the apparatus 10 of the present invention includes generally a cutter body 12, and one or more cutter knives 18,20. The cutter body 12 has a longitudinal bore 14 therethrough, for passage of a tubular conduit TC to which the apparatus 10 of the present invention may be attached. For example, the cutter body 12 can be captured in place longitudinally on the tubular conduit TC by threading of couplers (not shown), as is known in the art, on the ends of the section of tubular conduit TC, above and below the cutter body 12.

The cutter body 12 has a generally longitudinal knife chamber 16 in which the cutter knives 18,20 are slidably positioned. The cutter knives 18,20 have clamping bodies 22,24 near their upper ends. The clamping bodies 22,24 can be fastened together, as shown better in FIG. 2, to clamp tightly around a longitudinal member, such as a wireline WL, which is positioned externally to the tubular conduit TC. The clamping bodies 22,24 can be bolted together at mating surfaces 50 as is well known in the art. The bolts and bolt holes are omitted in these views, for the sake of clarity.

Figure 3:
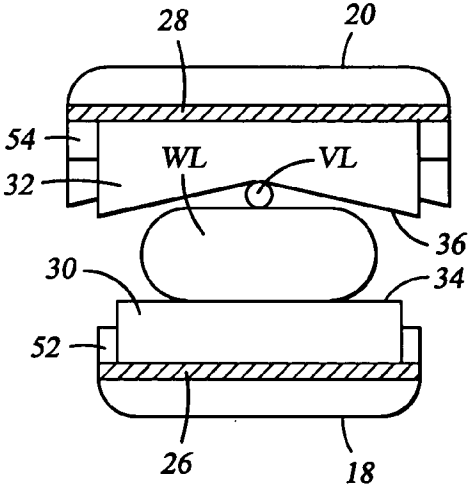
FIG. 3 is a transverse section view of the apparatus shown in FIG. 1, taken at the line 3—3.

The cutter knives 18,20 have thinner mid-sections 26,28, which can flex to allow the lower ends of the knives 18,20 to deflect inwardly, as will be explained below. Cutter blades 30,32 are mounted on the knives 18,20 near their lower ends, with the blades 30,32 having cutting edges 34,36 facing each other, or facing inwardly. FIG. 3 shows this orientation of the cutting edges 34,36. Stiffeners 52,54 can be provided on the cutter knives 18,20 if required.

Figure 2:
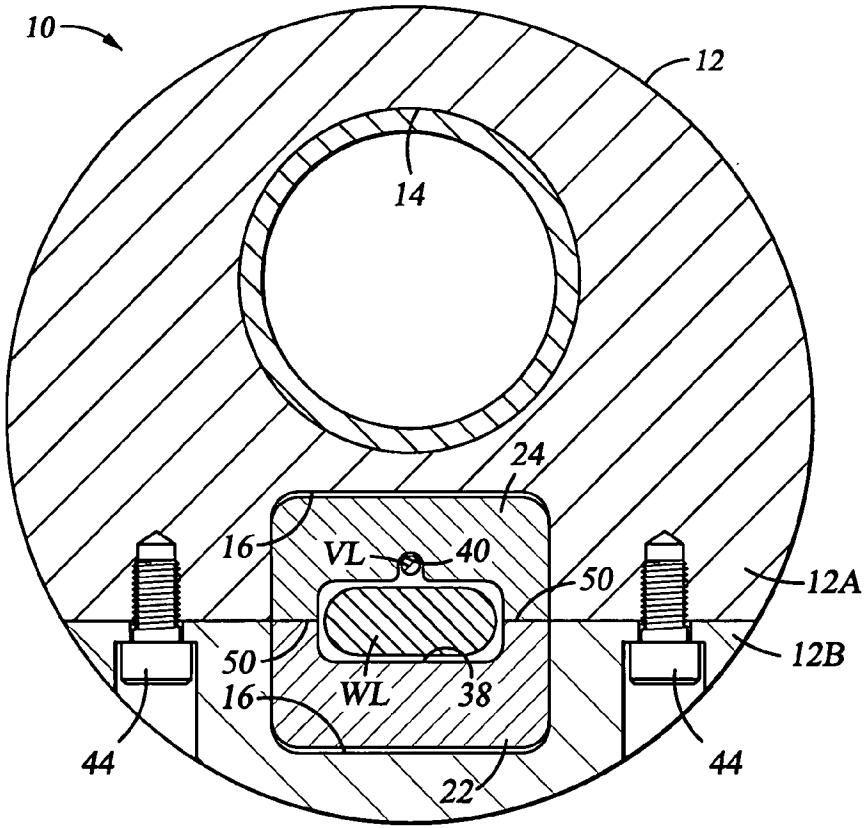
FIG. 2 is a transverse section view of the apparatus shown in FIG. 1, taken at the line 2—2.

As seen in FIGS. 1 through 3, a wire line passage 38 is provided longitudinally through the cutter body 12, as is a vent line passage 40. Similarly, a passage could be provided for a control line or any other kind of external longitudinal member that may be in use next to the tubular conduit TC. These longitudinal member passages 38,40 position the external longitudinal members VL,WL between the cutter knives 18,20, and specifically between the cutting edges 34,36. As shown in FIG. 3, one cutting edge 36 can be V-shaped to centralize the vent line VL and the wire line WL between the cutting edges 34,36.

A set of teeth or serrations 42 can be provided within the wireline passage 38, to facilitate holding the cutter knives 18,20 in position longitudinally relative to the wireline WL, when the clamping bodies 22,24 are bolted together. The portion of the wireline passage 38 between the clamping bodies 22,24 is dimensioned to slightly squeeze the wireline WL, without collapsing it or otherwise damaging it. The vent line passage 40 is dimensioned to allow passage of the vent line VL without squeezing it. As shown in FIG. 2, bolts and bolt holes 44 are provided to bolt together the two halves 12A,12B of the cutter body 12, in a similar fashion to that contemplated for the clamping bodies 22,24. Bolting together of the two cutter body halves 12A,12B facilitates positioning of the cutter knives 18,20 within the knife chamber 16.

As shown best in FIG. 1, one or more sloping surfaces 46,48 are provided at the lower end of the knife chamber 16, sloping longitudinally and inwardly toward the longitudinal members VL,WL passing through the cutter body 12. The lower ends of the cutter knives 18,20 abut these sloping surfaces 46,48. Rather than having two distinct sloping surfaces, a conical sloping surface could be used with a plurality of inwardly facing knives.

The configurations shown in FIGS. 1 and 3 represent the made-up or run-in configuration of the apparatus 10. After the tubular conduit TC and the bottom hole assembly (not shown) are positioned in the well bore, it may become necessary to sever the tubular conduit TC, the vent line VL, and the wire line WL above the bottom hole assembly and retrieve them from the well bore. After the tubular conduit TC is severed, by any means known in the art, the upper portion of the tubular conduit TC is pulled upwardly, or in the uphole direction.

Figure 5:
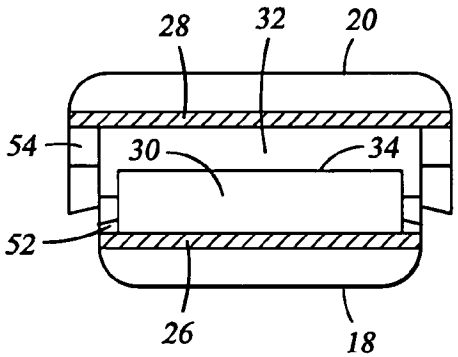
FIG. 5 is a transverse section view of the apparatus shown in FIG. 1, showing the actuation of the cutter knives.
Figure 4:
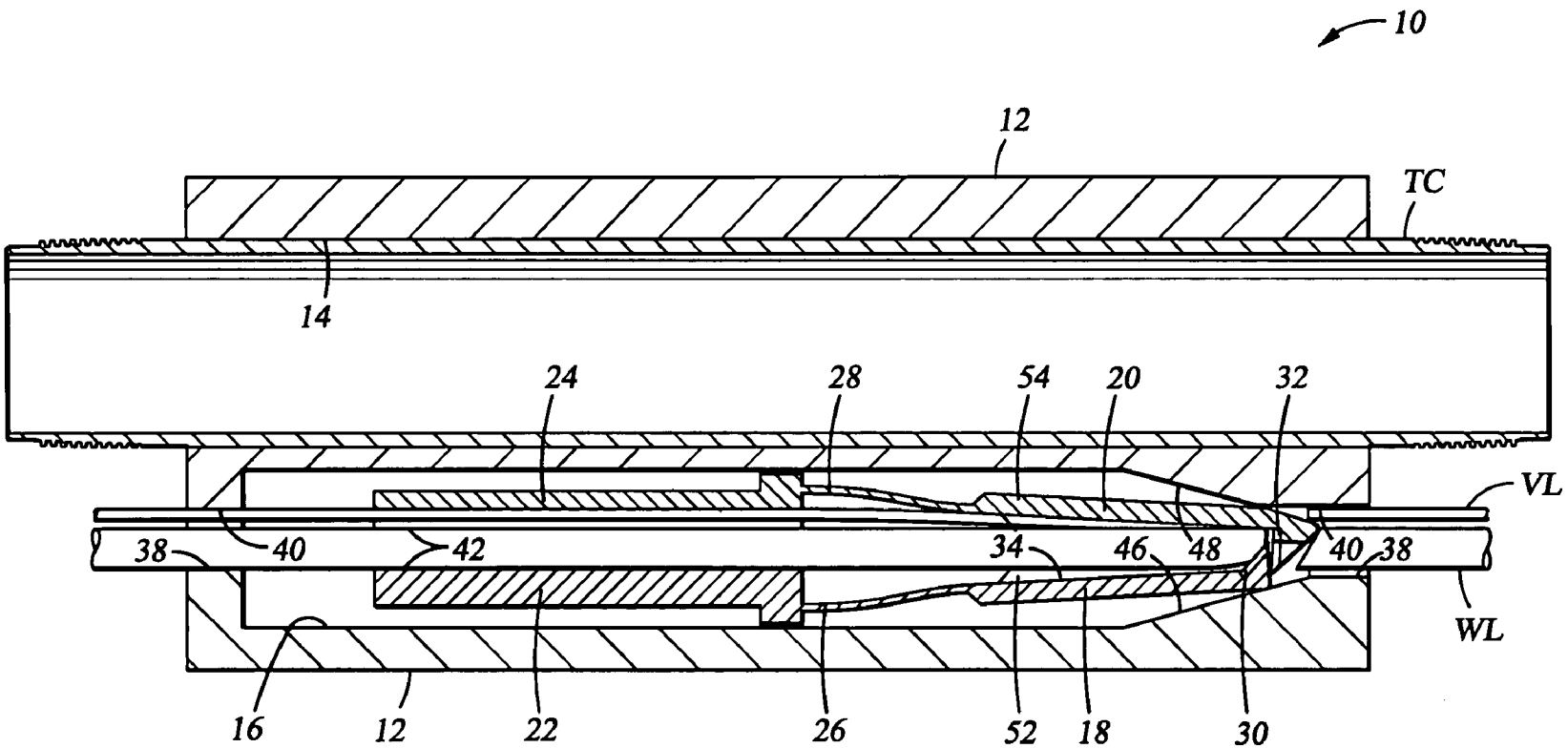
FIG. 4 is a partial longitudinal section view of the apparatus shown in FIG. 1, showing the actuation of the cutter knives.

As shown in FIG. 4, this lifts the cutter body 12 in the uphole direction. Since the cutter knives 18,20 are clamped in position longitudinally on the wire line WL, the lower end of which is still attached to the bottom hole assembly, the cutter knives 18,20 are forced inwardly by the sloping surfaces 46,48 in the cutter body 12, as the cutter body 12 rises. This forces the cutting edges 34,36 of the blades 30,32 toward each other, through the longitudinal members VL,WL, severing them. FIG. 5 shows the overlapping of the cutter blades 30,32 after the cutter knives 18,20 have been forced fully inwardly by the sloping surfaces 46,48. After the severing operation, the upper portions of the external longitudinal members VL,WL can be retrieved from the well bore.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. An apparatus for cutting of a longitudinal member run external to a tubular conduit in a well bore, said apparatus comprising:

a cutter body attachable to a tubular conduit in a fixed longitudinal position relative to said tubular conduit;

a cutter knife slidably mounted to said cutter body, said cutter knife being adapted to fasten to a longitudinal member external to said tubular conduit, in a fixed longitudinal position relative to said external longitudinal member; and a surface on said cutter body oriented to slidingly abut said cutter knife and to force said cutter knife through said external longitudinal member upon lifting of said cutter body relative to said cutter knife.

2. The apparatus recited in claim 1, further comprising a plurality of said cutter knives located on opposing sides of said external longitudinal member.

3. The apparatus recited in claim 1, further comprising a passage through said cutter body located to position said external longitudinal member adjacent a cutting edge of said cutter knife.

4. The apparatus recited in claim 3, further comprising at least one said passage through said cutter body located to position a plurality of said external longitudinal members adjacent a cutting edge of said cutter knife.

5. An apparatus for cutting of a longitudinal member run external to a tubular conduit in a well bore, said apparatus comprising:

a cutter body attachable to a tubular conduit in a fixed longitudinal position relative to said tubular conduit;

a plurality of cutter knives slidably mounted to said cutter body, each said cutter knife slidably abutting at least one surface on said cutter body, said cutter knives being adapted to fasten to a longitudinal member external to said tubular conduit, in a fixed longitudinal position relative to said external longitudinal member; and a cutting edge on each said cutter knife, each said cutting edge being oriented toward said external longitudinal member, said cutting edges being located on opposing sides of said external longitudinal member, said at least one surface on said cutter body being oriented to force said cutting edges toward each other, through said external longitudinal member, upon lifting of said cutter body relative to said cutter knives.

6. The apparatus recited in claim 5, further comprising a passage through said cutter body located to position said external longitudinal member between said cutting edges.

7. The apparatus recited in claim 6, further comprising at least one said passage through said cutter body located to position a plurality of said external longitudinal members between said cutting edges.

8. A method for cutting of a longitudinal member run external to a tubular conduit in a well bore, said method comprising:

attaching a cutter body to a tubular conduit being run into a well bore, said cutter body being attached in a fixed longitudinal position relative to said tubular conduit;

fastening at least one cutter knife to a longitudinal member being run into the well bore external to said tubular conduit, said at least one cutter knife being fastened in a fixed longitudinal position relative to said external longitudinal member, said at least one cutter knife being slidably mounted to said cutter body;

cutting said tubular conduit below said cutter body;

lifting said cutter body relative to said at least one cutter knife, by lifting said tubular conduit; and slidingly abutting at least one surface on said cutter body with said at least one cutter knife to force said at least one cutter knife through said external longitudinal member upon said lifting of said cutter body.

9. The method recited in claim 8, further comprising:

fastening a plurality of said cutter knives to said external longitudinal member on opposing sides of said external longitudinal member; and slidingly abutting said at least one surface on said cutter body with said plurality of cutter knives to force said plurality of cutter knives toward each other through said external longitudinal member upon said lifting of said cutter body.

10. The method recited in claim 8, further comprising:

fastening a plurality of said cutter knives to one said external longitudinal member, said plurality of cutter knives being positioned on opposing sides of a plurality of said external longitudinal members; and slidingly abutting said at least one surface on said cutter body with said plurality of cutter knives to force said plurality of cutter knives toward each other through said plurality of external longitudinal members upon said lifting of said cutter body.

* * * * *